US007226202B2

(12) United States Patent
Chen

(10) Patent No.: US 7,226,202 B2
(45) Date of Patent: Jun. 5, 2007

(54) QUICK CONNECTION LAMPPOST

(76) Inventor: Yu Shi Chen, Shanghai Chief Electrical Apparatus Co., Ltd No. 5942 HuYi Road, JiaDing District, Shanghai, 201806 (CN)

( * ) Notice: Subject to any disclaimer, the term of this patent is extended or adjusted under 35 U.S.C. 154(b) by 162 days.

(21) Appl. No.: 11/151,795

(22) Filed: Jun. 14, 2005

(65) Prior Publication Data

US 2006/0291220 A1 Dec. 28, 2006

(51) Int. Cl.
*H01R 33/00* (2006.01)

(52) U.S. Cl. ..... 362/649; 362/406; 362/651; 439/334

(58) Field of Classification Search ..... 362/406, 362/410, 649, 651–652, 655–656; 439/332–337
See application file for complete search history.

(56) References Cited

U.S. PATENT DOCUMENTS 1,158,578 A * 11/1915 Stearns ..... 439/336
6,761,469 B2 * 7/2004 Wu ..... 362/655
2002/0163813 A1 * 11/2002 Tseng ..... 362/404

* cited by examiner

*Primary Examiner*—Sandra O'Shea
*Assistant Examiner*—Jason Moon Han
(74) *Attorney, Agent, or Firm*—Clement Cheng

(57) ABSTRACT

A lamp base has a lamppost and a base. One end of the lamppost has a connection element and the base has a connection component that corresponds to a connection element. The lamp base is assembled in sequence, with first the lamppost, the connection piece, the insulation piece and then contact points. Inside the lamppost are electrical wires connected to the contact points.

5 Claims, 5 Drawing Sheets

120
111
115
100a
112
109
108
107
116
113
106
105
114
104
103
102
100
101
120
101

QUICK CONNECTION LAMPPOST

FIELD OF THE INVENTION

This invention involves lamps and specifically a kind of lamp base that can be dissembled.

DISCUSSION OF RELATED ART

The construction shown in FIG. 1 is the kind of lamppost connection 1 that is most commonly seen in floor lamps or similar lamps on the market at this time. Lamppost 2 and lamppost 3 are joined together by a connector 4 with screw threads; electrical wires 5 pass through the hollow chambers in the middle of the posts thereby allowing passage from the electricity source end 6 to the load end 7.

Because the electrical wires 5 must pass through lamppost 2, the connector 4, and lamppost 3, when a consumer connects the lampposts 1 he needs to pull the wires 5 and turn the lampposts 2 and 3 (turning over five revolutions) in order to accomplish the assembly. As a result, the wires 5 are often damaged unintentionally, thereby leading to short-circuit [leakage] and hazards. Although the lampposts may be disassembled for shipping, the wires within cannot be removed. The wires are pulled and shuffled during packing, which creates a potential hazard. Furthermore, packing is difficult because of the bulky size.

With the current lamp connection FIG. 1, a lamppost passes through a hole in the base and the lamppost is locked tight with a screw on the inside of the base. However, because the lamppost and the base are attached with a screw, they may not be taken apart easily, which results in bulky volume for shipping, higher costs for shipping, and ultimately higher prices when the consumer buys the lamp. Also, when the consumer hangs the lamp, he needs to hang the entire lamp to the ceiling; because of the heavier weight of the lamp, potential hazards exist in the hanging process. When problems occur to the lamp, the consumer has to take the entire lamp down from the ceiling in order to perform maintenance or repair, which is very inconvenient.

SUMMARY OF THE INVENTION

This practical new design involves a lamp base, the characteristics of which are that: One end of the lamppost has a connection element; the base has a connection component that matches said connection element. When used, the connection element that is at one end of the lamppost of this new design is inserted through a hole on the base; its raised point is lined up with the notch on the connection component; the connection element is rotated to lock the raised point into the notch; and then, the lamppost ring is twisted tight so that the lamppost is securely attached to the base. This kind of lamppost and lamp base can be assembled and disassembled very easily, furthermore, the lamppost and the base can be packed separately for shipping; by so doing, the costs of shipping and packing are greatly reduced and resources are saved. At the same time, the consumer can hang the base of the lamp on the ceiling first, and then connect the lampposts one by one easily and safely.

DETAILED DESCRIPTION OF THE PREFERRED EMBODIMENT

The goal of the practical new design is to provide an improved lamp base that could cure certain shortcomings of awkward installation and removal of lamppost and base that are involved with the current technique. To realize the above goal, the strategy of this invention is: A type of lamp base made principally of the lamp post(s) and the base. Its characteristics are that a connection element is attached to one end of the lamppost. A connection component that matches this connection element is attached to the base.

When used, the connection element on one end of this design is passed through a hole in the base, the raised point on the connection element is lined up with the notch on the connection component, the connection element is rotated so that the raised point locks into the notch, and then the lamp post ring is turned tight so as to affix the lamp post firmly to the base; the assembling and disassembling of this kind of lamp post and base are very easy; also, because the lamppost and the base can be packed separately for shipping, the costs of shipping and packing are greatly reduced and resources are conserved. At the same time, when hanging the lamp, one can hang the base of the lamp to the ceiling first, and then connect the lampposts one by one, which would be easy and safe.

Figure 1:
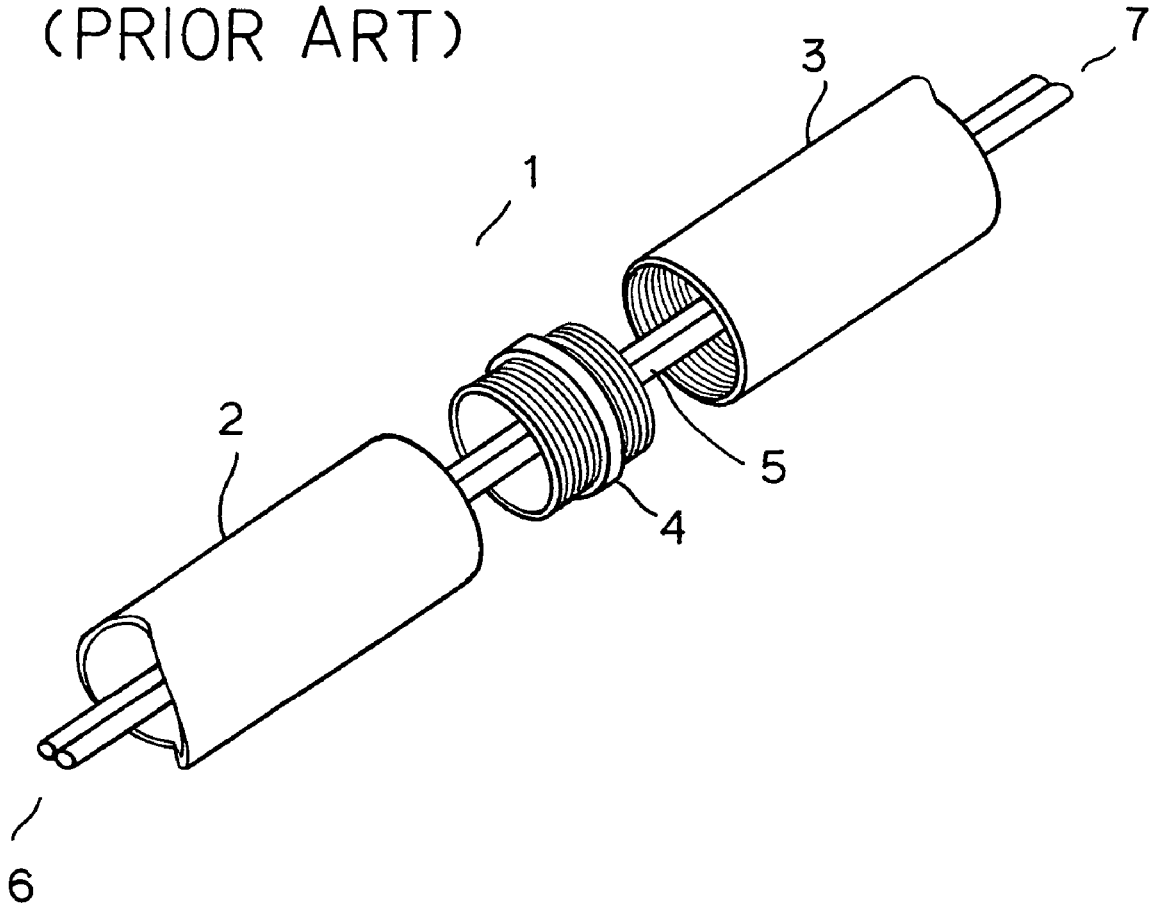
FIG. 1 (PRIOR ART)
FIG. 1 is a drawing of a conventional lamppost connection.
Figure 2:
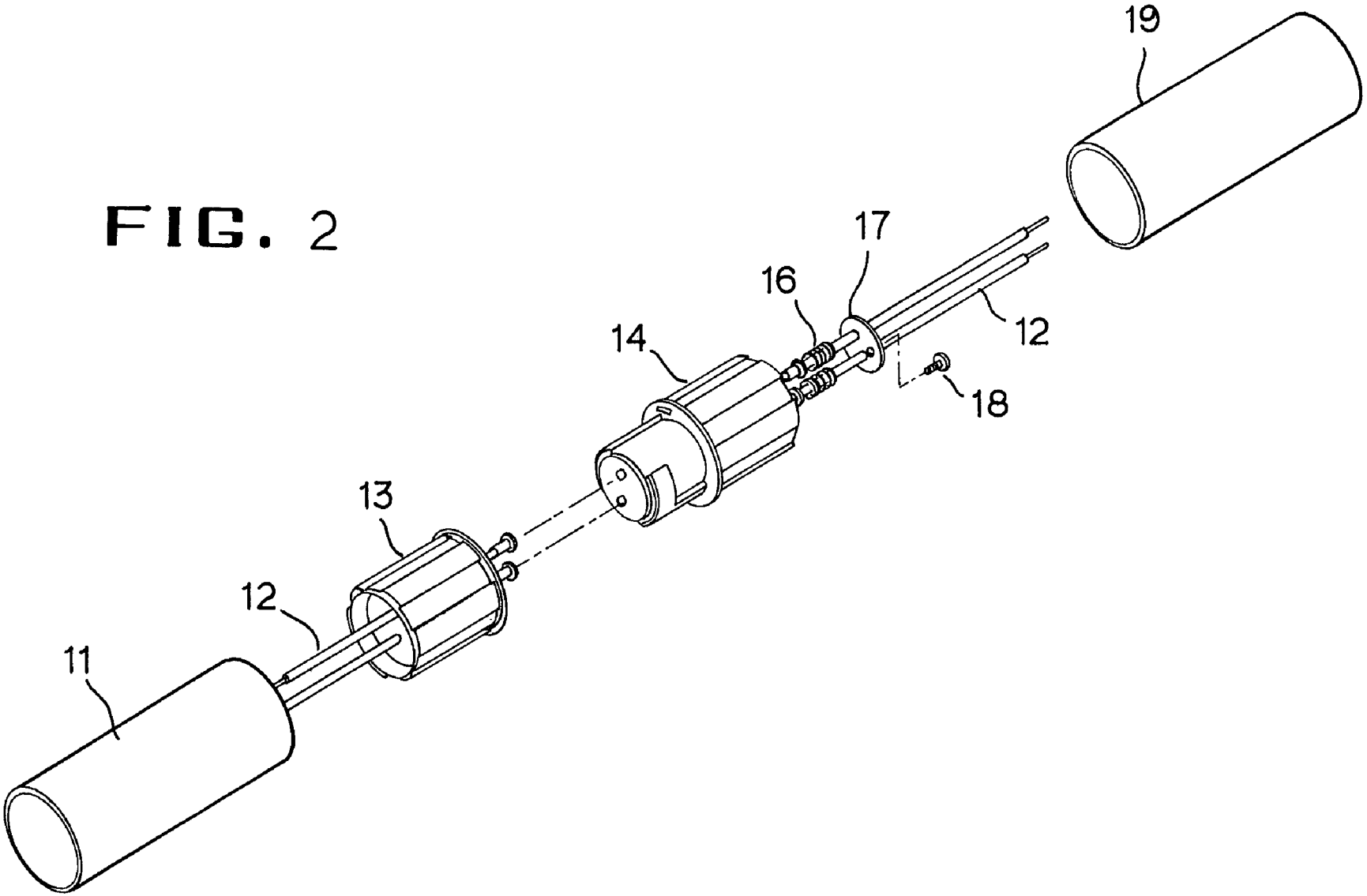
FIG. 2 is an exploded view of the improved lamppost of the present invention showing and in line connection of an intermediate section of the lamppost.

FIG. 2 shows an exploded view of the parts including lamp post 11, electrical wires 12, connector 13, connector 14, contact point, springs 16, insulation piece 17, screw 18, and lamp post 19.

Figure 3:
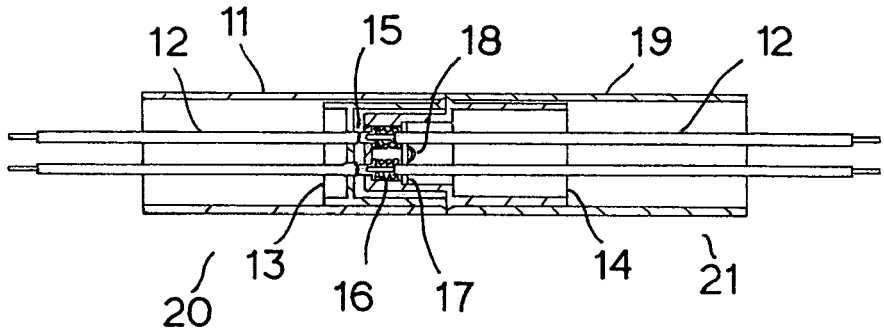
FIG. 3 is a cross sectional view of the lamppost of FIG. 2 in its assembled state.
Figure 4:
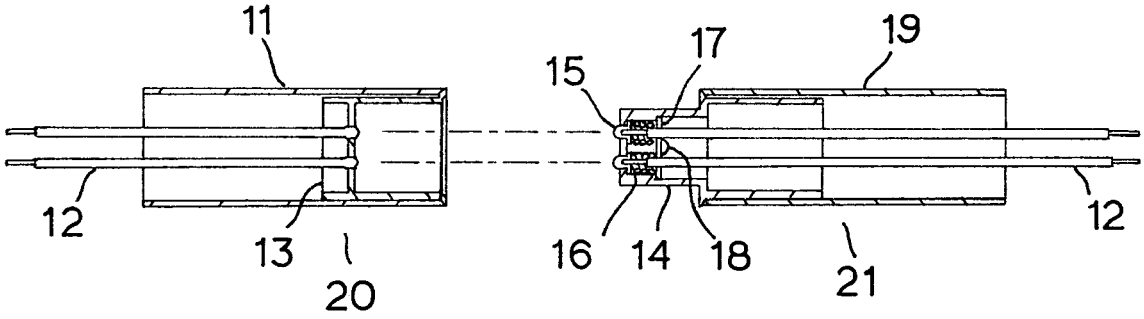
FIG. 4 is a cross sectional view similar to FIG. 3 showing the subassemblies of the lampposts disengaged.
Figure 5:
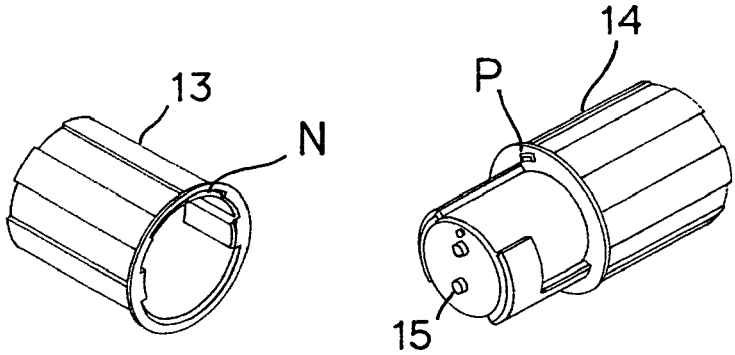
FIG. 5 is a perspective view of the pair of connectors of the lamppost subassemblies.

FIG. 3, 4, 5 shows the assembly method. Assemble 11, 12, 13 in the above picture into sub-assembly 20 as shown; and assemble 14, 15, 16, 17, 18, 19 into sub-assembly 21. As shown, horizontally insert sub-assembly 21 into the component 13 of sub-assembly 20. Make sure that the raised point P on the component 14 of sub-assembly 21 is lined up with the notch N on the component 13 of sub-assembly 20, and then, rotate sub-assembly 20 along the center axis by 30°; the contact points on the component 15 of sub-assembly 21 would precisely come into contact with the contact points on the component 12 of sub-assembly 20 thereby allowing electricity current to pass through. In this stage, the function of the springs 16 is to secure the points of contact.

Figures 6, 7:
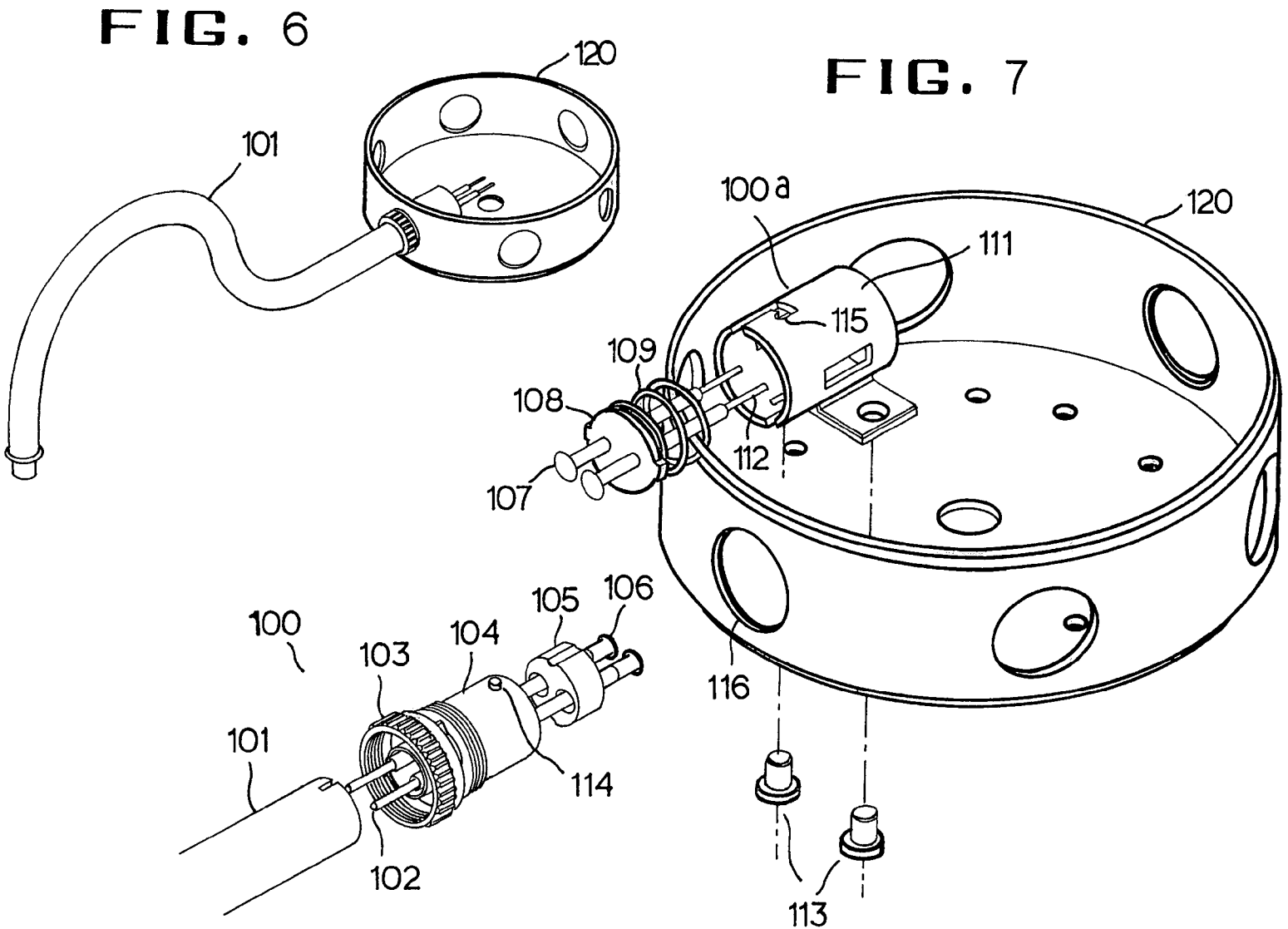
FIG. 6 is a drawing showing the structure of this invention applied to the base connection.
FIG. 7 is a drawing of the disassembled view of the structure of FIG. 6.
Figure 8:
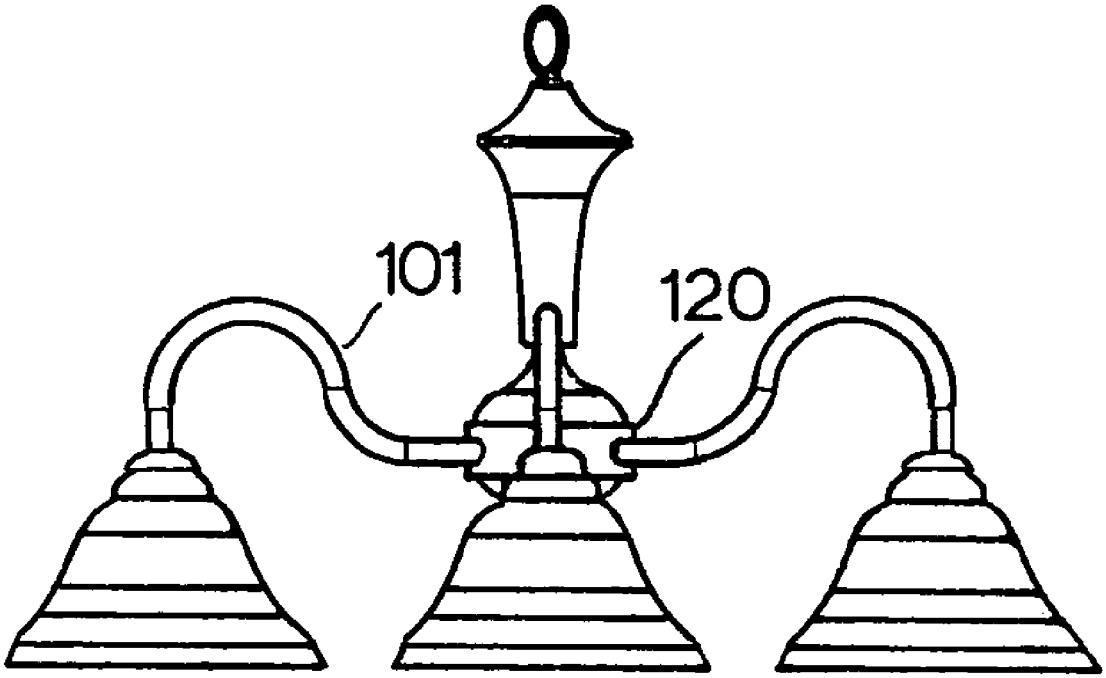
FIG. 8 is a reference drawing of this invention in use.

As seen in FIG. 6, 7, 8, this invention consists principally of the lamppost 101 and base 120. Its characteristics are: A connection element 100 is set at one end of the lamppost; a connection component 100*a* that matches this connection element is set in the base. The connection element is made by connecting together, in sequence, lamp post ring 103, connection component 104, insulation piece 105, and contact points 106; inside the lamp post are electrical wires 102, the electrical wires are connected to the contact points 106. The connection component is made by connecting together, in sequence, contract points 107, an insulation piece 108, springs 109, and the wire connector 111. Inside the connection component are electrical wires 112, one end of the wires is connected to the contact points 107. The other end of the wires is connected to the connection component. On the connection element is a raised point 114. On the connection component is a notch 115 that matches the raised point, said notch is in the shape of a hook. On the connection component are two connection pieces; on each of the connection pieces is a screw hole; the connection pieces are affixed to the base by a screw 113; the base is in the shape of a disk. On the side of the disk are a certain number of small holes; its diameter is larger than the diameter of the insertion device.

At time of assembly, pass the connection element 100 through a hole 116 in the base. Line up the raised point 114 on the connection element 100 with the notch 115 on the connection component 100*a*. Rotate the connection element toward the connection component by 30 degrees. Release the hands and the springs 109. The connection component 100*a* will push the raised point 114 into the notch 115. Because the notch 115 is the shape of an upside-down hook, the raised point 114 is locked inside the notch 155. Next, turn the screw threads on the lamppost that wrap around the insulation piece in clockwise direction and lock it tight. At this point, the installation of a single lamppost to the base is complete. If the lamp has multiple lampposts, repeat the preceding installation steps.

ADVANTAGES OF THE INVENTION

The various parts of the lamps that use this technology for connection can be packed completely separately, which can reduce the cost of packing the products to the maximum. The electrical wires are connected only in the enclosed lamppost units. The electrical wires are not visible on the outside. The rotation during assembly has nothing to do with the electrical wires. The electrical wires would not be damaged from scraping. As a result, it is safer than the current technique. When assembling the lamp, a consumer needs only to perform the actions of insertion and rotation, which makes it easy and safe for the consumer. It is common knowledge that electrical wires are polarity specific. In the event the polarities are mixed up during assembly, hazards may be created. The raised point and notch design that is shown in the partial view ensures the differentiation of the polarities of the electrical wires thereby preventing the potential hazards that is produced by reversed polarity in connection.

The invention claimed is:

1. A lamp connection system comprising: a lamppost and base; a first connection element set at one end of the lamppost; a second connection component that matches the first connection element is set in the base; the first connection element is made by connecting together; a lamp post ring securing the outside surface of the lamppost to the base, an insulation piece, and contact points; wherein inside the lamp post are electrical wires, the electrical wires connected to the contact points, wherein the second connection component is made by connecting together contract points, an insulation piece, springs, and a wire connector, wherein inside the connection component are electrical wires, and one end of the wires is connected to the contact points and the other end of the wires is connected to the connection component, wherein the connection element has a raised point and on the second connection component is a notch that matches the raised point, wherein said notch is in the shape of a hook, wherein on the connection component are two connection pieces; wherein on each connection piece is a screw hole; wherein the connection pieces are affixed to the base by screw connection.

2. The lamp base of claim 1, wherein the base is in the shape of a disk and on the side of the disk are a certain number of small holes.

3. The lamp base of claim 2, wherein there are two connection pieces on the wire connector; on the connection piece is a screw hole; the connector pieces are fixed onto the base with screws.

4. The lamp base of claim 1, wherein there are two connection pieces on the wire connector; on the connection piece is a screw hole; the connector pieces are fixed onto the base with screws.

5. The lamp base of claim 1, wherein the base is in the shape of a disk; on the side of the disk are a certain number of small holes; its diameter is larger than the diameter of the connection element.

* * * * *